US007441581B2

(12) United States Patent
Pitzen

(10) Patent No.: US 7,441,581 B2
(45) Date of Patent: Oct. 28, 2008

(54) ADHESIVE TAPE APPLICATOR

(75) Inventor: James F. Pitzen, Maplewood, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 391 days.

(21) Appl. No.: 11/077,262

(22) Filed: Mar. 10, 2005

(65) Prior Publication Data

US 2006/0201632 A1 Sep. 14, 2006

(51) Int. Cl.
*B65D 85/02* (2006.01)
*B32B 37/22* (2006.01)

(52) U.S. Cl. ..... 156/577; 156/574; 156/579; 225/46; 225/65; 206/411

(58) Field of Classification Search ..... 156/574, 156/577, 579; 225/33, 46, 56, 65, 88; 206/411
See application file for complete search history.

(56) References Cited

U.S. PATENT DOCUMENTS

| | | | | |
|---|---|---|---|---|
| 3,187,968 | A | 6/1965 | Favre | |
| 3,537,942 | A | 11/1970 | Kefalos | |
| 3,740,297 | A | 6/1973 | Vidinsky | |
| 3,900,362 | A | 8/1975 | Schaffer | |
| 4,093,494 | A * | 6/1978 | Boettcher | 156/577 |
| 4,238,271 | A | 12/1980 | Urushizaki | |
| 5,269,871 | A | 12/1993 | Longworth et al. | |
| 6,302,177 | B1 | 10/2001 | Gruber | |
| 6,478,068 | B1 * | 11/2002 | Brown | 156/577 |
| 6,742,562 | B2 | 6/2004 | Pitzen | |
| 2003/0234083 | A1 * | 12/2003 | Pitzen | 156/577 |
| 2005/0055981 | A1 * | 3/2005 | Smythe et al. | 52/749.1 |
| 2007/0012406 | A1 * | 1/2007 | Kakade | 156/577 |

FOREIGN PATENT DOCUMENTS

| | | | |
|---|---|---|---|
| WO | WO 2004/000705 | A1 | 12/2003 |
| WO | WO 2005/066054 | A1 | 7/2005 |

OTHER PUBLICATIONS

Patent application entitled "Masking Tape Applicator;" U.S. Appl. No. 10/748,567; Somers, Micah T., Hallee, Nathaniel R. and Pitzen, James F.; filed Dec. 30, 2003; pp. 1-22 w/ attached Figures 1-5.

* cited by examiner

*Primary Examiner*—Mark A Osele
(74) *Attorney, Agent, or Firm*—David B. Patchett

(57) ABSTRACT

A tape application apparatus is adapted for both left-handed and right-handed use when applying tape from a roll to a first surface. An edge of the first surface is common to an edge of an adjacent second surface. The tape application apparatus includes a housing and a tape hub attached to the housing that is capable of slidably receiving the roll. The housing has first and second exterior surfaces and first and second interior surfaces and is capable of receiving the roll. When the tape application apparatus is guided in a first direction, the roll is moveable to a first dispensing position against the first interior side surface, and when the tape application apparatus is guided in a second direction opposite the first direction, the roll is moveable to a second dispensing position against the second interior side surface.

13 Claims, 6 Drawing Sheets

ADHESIVE TAPE APPLICATOR

BACKGROUND OF THE INVENTION

The present invention generally relates to the field of adhesive tape applicators. In particular, the invention relates to an adhesive tape applicator capable of both right-handed and left-handed application.

When applying coatings (e.g., paint, varnish, etc.), adjacent surfaces often need to be coated individually. As such, when one surface is being coated but adjoining surfaces are not, it is desirable to protect or mask those adjoining surfaces in order to avoid inadvertently coating them. In some situations, the surface to be protected has an edge common to an edge of the surface to be coated. For example, the surface to be coated may be a wall attached along a corner edge to another wall, or a wall having a door or window molding mounted thereon. Without the use of some form of masking arrangement, these configurations make it difficult to coat the desired surface without also inadvertently coating the adjoining surface.

Many adhesive tape applicators are known for applying a strip of tape (e.g., masking tape) from a roll onto a surface to be masked. Typically, the roll is positioned on a hub of the tape applicator and a free end of tape from the roll is adhered to the surface to be protected. Movement of the tape applicator over the surface then applies the strip of tape to the surface to be protected in a straight line, with a side edge of the tape extending along the common edges of the adjoining surfaces. During such application, the tape applicator guides the strip of tape along and onto the surface to be protected.

Current tape applicators cannot be used while moving in either of two opposite directions along the surface to be protected without removing the roll from the hub of the tape applicator and repositioning the roll on the hub. In addition, current tape applicators do not allow a side edge of the tape applicator to align with a side edge of different sized rolls of tape. Current tape dispensers cannot dispense tapes of various widths.

BRIEF SUMMARY OF THE INVENTION

In one embodiment, the present invention is a tape application apparatus adapted for both left-handed and right-handed use when applying tape from a roll to a first surface. An edge of the first surface is common to an edge of an adjacent second surface. The tape application apparatus includes a housing and a tape hub attached to the housing that is capable of slidably receiving the roll. The housing has first and second exterior surfaces and first and second interior surfaces and is capable of receiving the roll. When the tape application apparatus is guided in a first direction, the roll is moveable to a first dispensing position against the first interior side surface, and when the tape application apparatus is guided in a second direction opposite the first direction, the roll is moveable to a second dispensing position against the second interior side surface.

In another embodiment, the present invention is a tape applicator for applying a strip of tape from a roll onto a first surface. The roll has a first width and the strip of tape has a first edge and a second edge. An edge of the first surface is common to an edge of a second adjacent surface. The tape applicator includes a frame adapted to receive the roll and a tape hub attached to the frame. The frame has a first tape dispensing edge on a first side of the frame and a second tape dispensing edge on a second side of the frame. The tape hub has a second width that is greater than the first width of the roll and is formed to slidably receive the roll. The roll is slidable between a first dispensing position and a second dispensing position. When in the first dispensing position, the first side edge of the strip of tape is dispensed from the roll co-linearly with the first dispensing edge of the first side of the frame. When in the second dispensing position, the second side edge of the strip of tape is dispensed from the roll co-linearly with the second dispensing edge of the second side of the frame.

In another embodiment, the present invention is a method for applying a first strip of tape from a roll mounted on a hub of a tape dispensing frame to a first surface in a first direction and subsequently applying a second strip of tape from the roll mounted on the hub of the tape dispensing frame to the first surface in a second direction. An edge of the first surface is common to an edge of a second surface adjacent to the first surface. The roll is positioned in a first dispensing position relative to the tape dispensing frame such that a first side edge of tape being dispensed is co-linear with a first dispensing edge of the tape dispensing frame. The tape dispensing frame is placed on the first surface and the first dispensing edge is aligned with the second surface such that the first dispensing edge touches, but does not overlap the second surface. The tape dispensing frame is moved in the first direction while adhering a length of tape from the roll to the first surface. The length of tape adhered to the first surface is separated from the roll to define the first strip of tape. The roll is then slid in a first direction across the hub to position the roll in a second dispensing position relative to the tape dispensing frame such that a second side edge of tape being dispensed is co-linear with a second dispensing edge of the tape dispensing frame. The tape dispensing frame is placed on the first surface and the second dispensing edge is aligned with the second surface such that the second dispensing edge touches, but does not overlap the second surface. The tape dispensing frame is moved in the second direction while adhering a length of tape from the roll to the first surface. The length of tape adhered to the first surface is separated from the roll to define the second strip of tape.

The above summary is not intended to describe each disclosed embodiment or every implementation of the present invention. The figures and the detailed description which follow more particularly exemplify illustrative embodiments.

BRIEF DESCRIPTION OF THE DRAWINGS

The present invention will be further explained with reference to the drawings figures listed below, where like structure is referenced by like numerals throughout the several views.

While the above-identified figures set forth one embodiment of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention.

DETAILED DESCRIPTION

Figure 1:
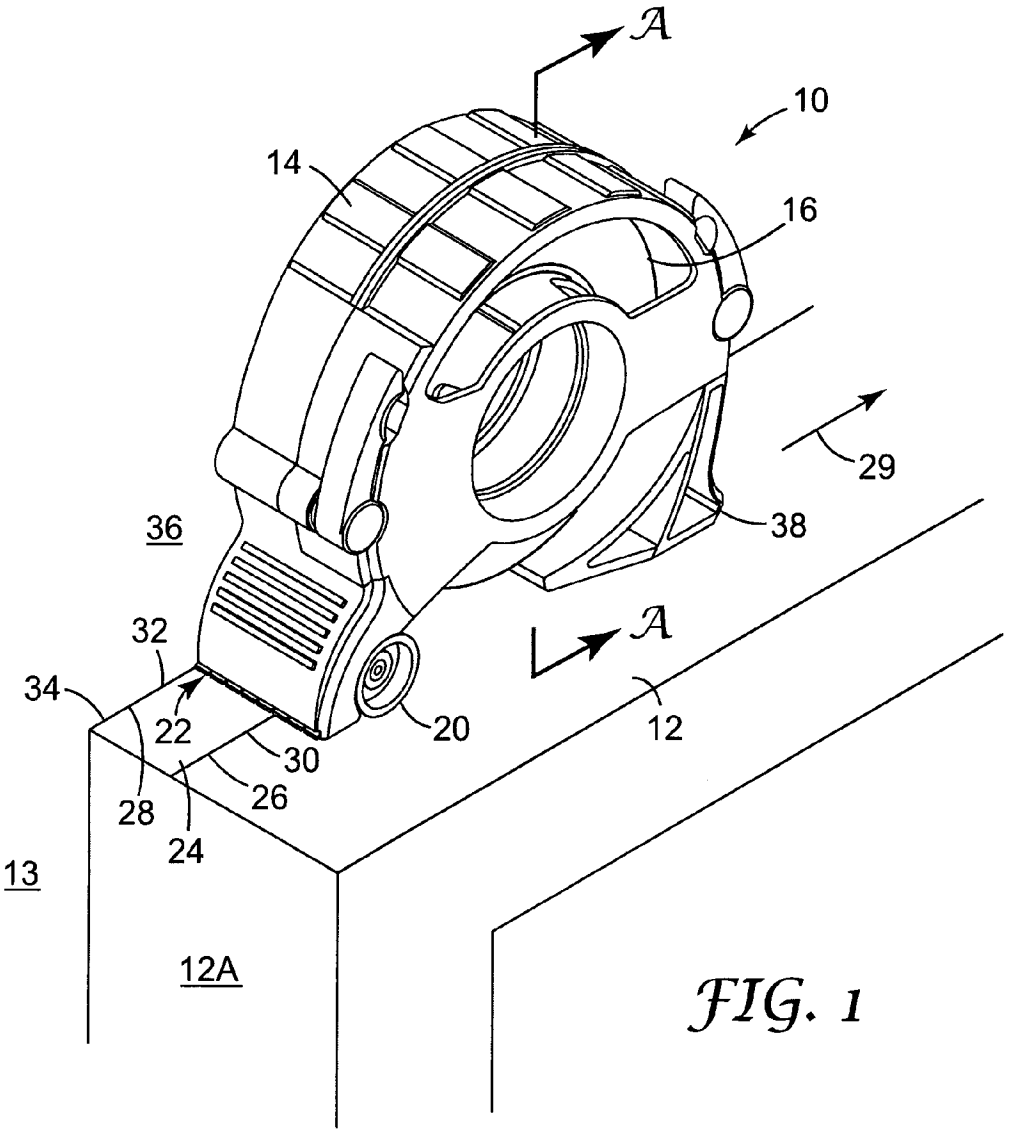
FIG. 1 is a perspective view of an adhesive tape applicator of the present invention.

FIG. 1 is a perspective view of an adhesive tape applicator 10 of the present invention positioned on a first surface 12 to be protected or masked. The first surface 12 may be, for example, a side of a door or window frame 12A which projects from a wall 13. Tape applicator 10 generally includes a housing 14 adapted to receive a roll 16, a tape hub 18 (tape hub 18 shown in detail in FIG. 2), tape application rollers 20, and cutting edge 22. Tape applicator 10 is used to apply a strip 24 of tape 26 having first and second side edges 28 and 30 from roll 16 along first surface 12 (moving in direction of arrow 29). Typically, first surface 12 has an edge 32 common to an edge 34 of a second surface 36 (i.e., wall 13) adjacent to first surface 12. In order for strip 24 of tape 26 to effectively protect first surface 12 at edge 32, tape applicator 10 must be placed flush against second surface 36, as shown in FIG. 1, so that rollers 20 and a rear foot 38 of tape applicator 10 are placed on first surface 12 and first side edge 28 of strip 24 of tape 26 is aligned co-linearly with edge 32 of first surface 12.

Figure 2:
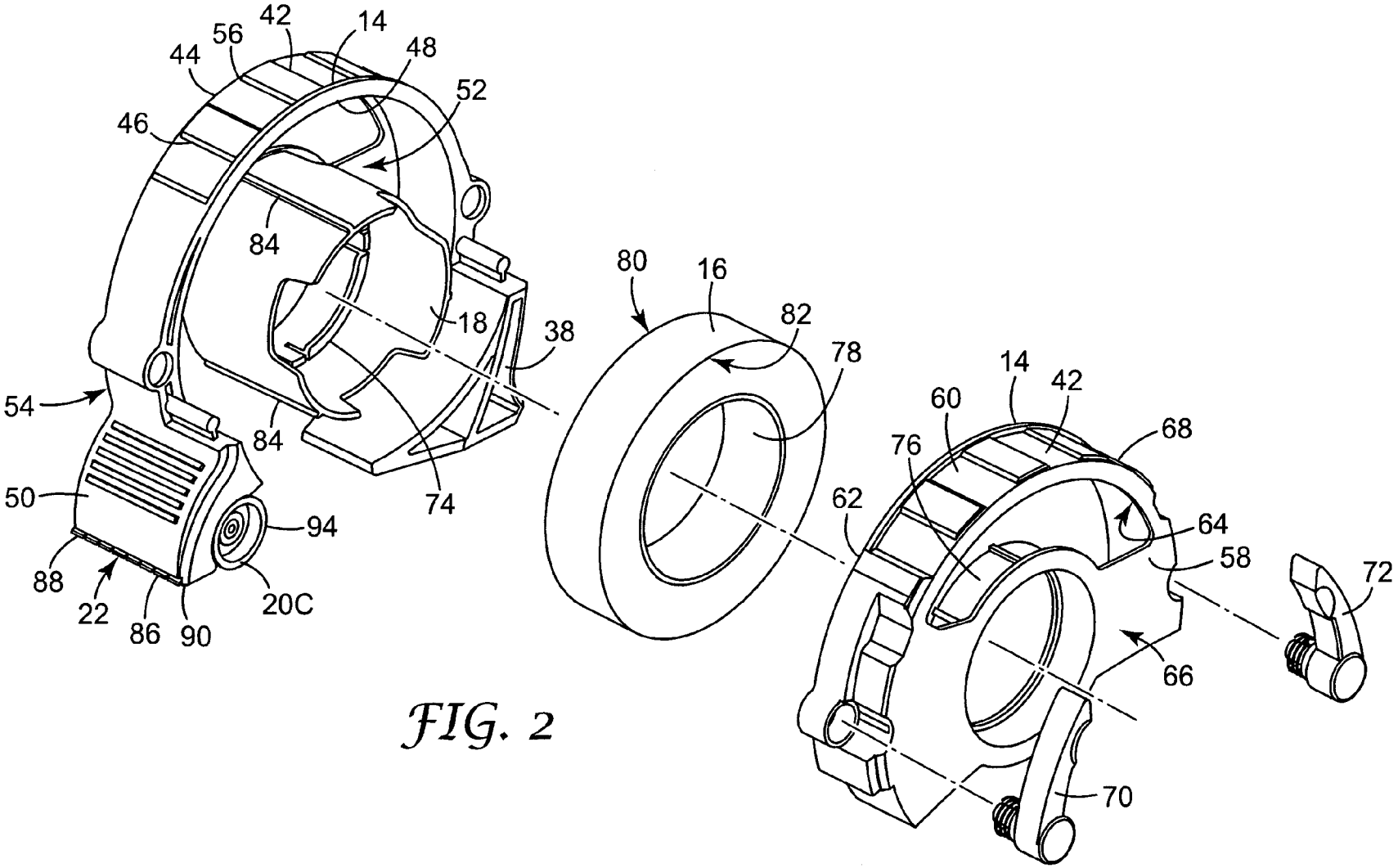
FIG. 2 is an exploded perspective view of the adhesive tape applicator of the present invention.
Figure 3:
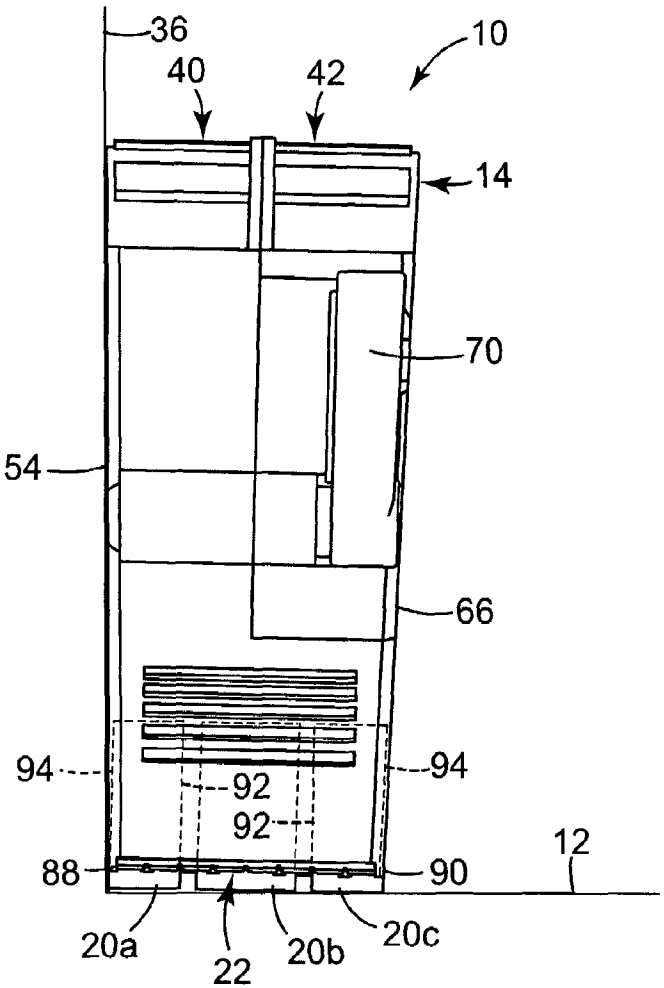
FIG. 3 is a front elevational view of the adhesive tape applicator of the present invention.

As seen in FIGS. 2 and 3, housing 14 comprises a first housing portion 40 and a second housing portion 42. First housing portion 40 generally comprises a side wall 44, an arcuate cover 46, an interior edge 48, a front portion 50, and rear foot 38. Wall 44 has an interior side surface 52 (see FIG. 4) adapted to receive roll 16 and an exterior side surface 54 adapted to engage a surface normal to the surface being masked. Cover 46 extends normally from an outer edge 56 of wall 44 to interior edge 48. Front portion 50 of cover 46 extends over application rollers 20 and terminates at cutting edge 22. Rear foot 38 is adapted to maintain tape applicator 10 in an upright position and guide tape applicator 10 along a surface when applying strip 24 of tape 26 to that surface.

Second housing portion 42 generally comprises a side wall 58, an arcuate cover 60, and an interior edge 62. Wall 58 has an interior side surface 64 (see FIG. 5) adapted to receive roll 16 and an exterior side surface 66 adapted to engage a surface normal to the surface being masked. Cover 60 extends normally from an outer edge 68 of wall 58 to interior edge 62. In one embodiment, housing 14 is molded from a polymeric material (e.g., polystyrene, ABS, or polypropylene).

When tape applicator 10 is assembled, first and second housing portions 40 and 42 are connected to each other at abutting or interengaging interior edges 48 and 62 to form an enclosure for maintaining roll 16 in housing 14. Housing portions 40 and 42 may be connected by any suitable means, such as friction fit, snap fit, or spring-biased means. In the illustrated embodiment, spring-biased levers 70 and 72 (shown in FIGS. 1 and 2) are manipulated to connect and disconnect housing portions 40 and 42. So long as housing portions 40 and 42 are firmly, yet releasably connected together (as seen in FIG. 1) to hold housing portions 40 and 42 together yet allow them to be separated for placement of roll 16 therein, any readily releasable coupling arrangement will suffice.

Tape hub 18 is attached to a mounting flange 74 on interior side surface 52 of first housing portion 40, spans the interior of housing 14, and extends over a mounting flange 76 attached to interior side surface 64 of second housing portion 42. Tape hub 18 is capable of slidably receiving rolls of tape of varying widths (as long as the inner diameter of a core 78 of each of the rolls of tape generally matches the outer diameter of tape hub 18). In one embodiment, tape hub 18 is adapted to receive rolls of tape with a three inch wide core, measured from a first side edge 80 of roll 16 to a second side edge 82 of roll 16.

A plurality of lateral ribs 84 on tape hub 18 assist to frictionally maintain roll 16 on tape hub 18 in either a first or a second dispensing position on tape hub 18. Tape roll 16 and hub 84 rotate together around flange 74. Although FIG. 2 depicts plurality of ribs 84 as the means for frictionally maintaining roll 16 on tape hub 18, other protrusion means may be used without departing from the scope of the invention. For example, a plurality of flexible fins, springs, or otherwise shaped protrusions may be provided to project outwardly from tape hub 18 to frictionally maintain roll 16 on tape hub 18.

Cutting edge 22 is positioned proximate application rollers 20 and is adapted for separating strip 24 of tape 26 from roll 16 by blade 86. Cutting edge 22 has a first dispensing edge 88 where cutting edge 22 and a plane of exterior side surface 54 of first housing portion 40 (e.g., plane 98 in FIG. 4) intersect and a second dispensing edge 90 where cutting edge 22 and a plane of exterior side surface 66 of second housing portion 42 (e.g., plane 99 in FIG. 5) intersect. Although blade 86 of cutting edge 22 is shown in FIG. 2 as having a row of teeth, blade 86 can be formed in a variety of shapes without departing from the scope of the invention. For example, blade 86 may be formed from a single metal blade or a serrated plastic blade.

Application rollers 20 comprise first application roller 20*a*, second application roller 20*b*, and third application roller 20*c* (shown in FIG. 3, with upper portions thereof shown in phantom) used to firmly apply strip 24 of tape 26 to first surface 12. First, second, and third application rollers 20*a*, 20*b*, and 20*c* are rotatably mounted to housing 14 adjacent cutting edge 22 between first and second dispensing edges 88 and 90. First and third application rollers 20*a* and 20*c* are positioned in housing 14 such that their outer edges are co-linear with first and second dispensing edges 88 and 90 of housing portions 40 and 42, respectively.

First and third application rollers 20*a* and 20*c* have interior side edges 92 with a diameter D1 and exterior side edges 94 with a diameter D2. Diameter D2 of exterior side edges 94 are slightly larger than diameter D1 of interior side edges 92. First and third application rollers 20*a* and 20*c* have differing interior and exterior diameters to assure that strip 24 is uniformly adhered to first surface 12. When tape 26 is unrolled from roll 16, application rollers 20 apply pressure to strip 24 of tape 26 as it is applied to first surface 12. Although FIG. 2 discusses application rollers 20 as comprising three application rollers, one roller may suffice or other number combinations of application rollers can be used without departing from the scope of the invention.

Figure 4:
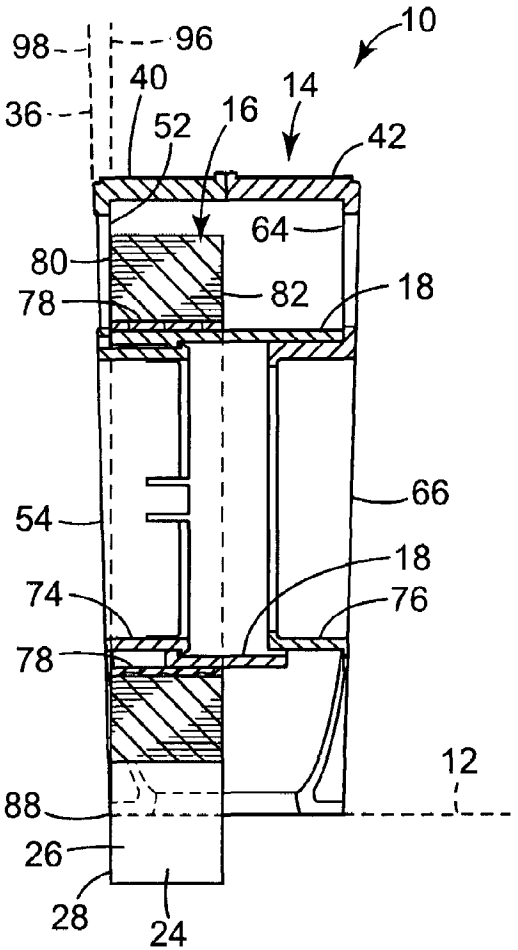
FIG. 4 is a cross-sectional view of the tape applicator of the present invention as taken along lines A-A in FIG. 1, showing a roll therein in a first dispensing position (with a projected strip of tape as dispensed from the roll).

As seen in FIG. 4, interior side surface 52 of first housing portion 40 lies in a first plane 96 adapted to engage first side edge 80 of roll 16. Likewise, interior surface 64 of second housing portion 42 lies in a first plane 97 adapted to engage second side edge 82 of roll 16. Exterior side surface 54 of first housing portions 40 lies in a second plane 98 adapted to guide housing 14 as it is manually slid against a surface perpendicular to first surface 12 and against which exterior side surface 54 abuts. First and second planes 96 and 98 are preferably disposed at an acute angle with respect to each other such that first and second planes 96 and 98 intersect at first dispensing edge 88. Exterior side surface 66 of second housing portions 42 lies in a second plane 99 adapted to guide housing 14 as it is manually slid against a surface perpendicular to first surface 12 and against which exterior side surface 66 abuts. First and second planes 97 and 99 are preferably disposed at an acute angle with respect to each other such that first and second planes 97 and 99 intersect at second dispensing edge 90. In one embodiment, second planes 98 and 99 of first and second exterior surfaces 54 and 66 are tapered relative to planes first 96 and 97, respectively, at an angle of between one and six degrees.

In a first dispensing position shown in FIG. 4, roll 16 is positioned on tape hub 18 of tape applicator 10 so that first side surface 80 of roll 16 abuts interior side surface 52 of first housing portion 40. Because tape applicator 10 is capable of housing rolls of tape of varying widths, roll 16 must be properly positioned on tape hub 18 prior to using tape applicator 10. When the width of roll 16 is less than the width of tape hub 18, roll 16 is maintained in position on tape hub 18 by ribs 84. When the width of roll 16 is approximately equal to the width of tape hub 18, roll 16 is maintained in position by ribs 84 and by interior side surfaces 52 and 64 of housing 14.

Because roll 16 is positioned against interior side surface 52 of first housing portion 40, strip 24 of tape 26 being dispensed from housing 14 is aligned such that first side edge 28 of strip 24 of tape 26 is co-linear with first dispensing edge 88, regardless of the width of roll 16. As a result, when exterior side surface 54 of first housing portion 40 is placed flush against second surface 36, first side edge 28 of strip 24 of tape 26 is dispensed directly along edge 32 of first surface 12 as tape applicator 10 is manually moved in a first direction.

As tape applicator 10 guides along first surface 12, tape 26 is applied to first surface 12 and secured in place by application rollers 20. Due to the larger diameter of exterior side edges 94 of first and third application rollers 20*a* and 20*c* (shown in FIGS. 2 and 3), greater pressure is applied to strip 24 of tape 26 at first and second dispensing edges 88 and 90. When roll 16 is in the first dispensing position (FIG. 4), first side edge 28 of strip 24 of tape 26 is co-linear with exterior side edge 94 of first application roller 20*a*. Exterior side edge 94 of first application roller 20*a* applies more pressure on first side edge 28 of strip 24 of tape 26 to ensure more secure adhesion of strip 24 of tape 26 to first surface 12.

Figure 5:
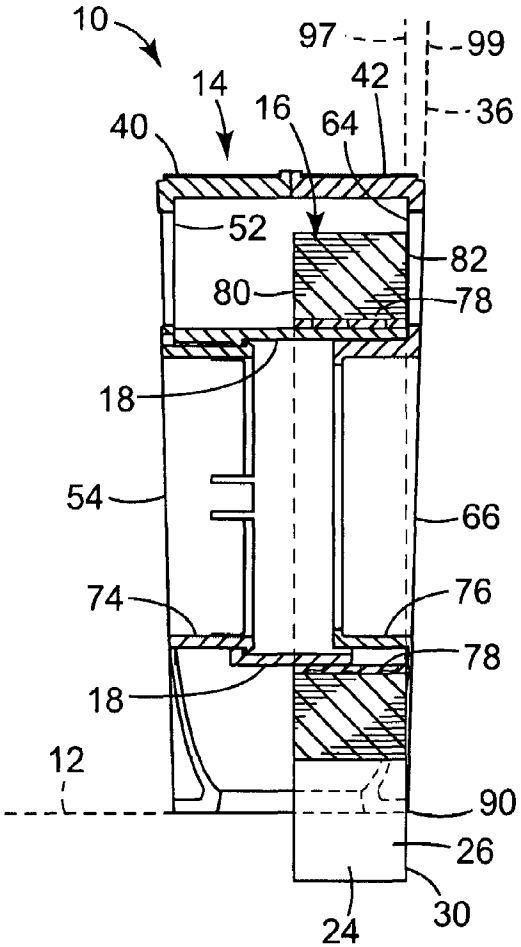
FIG. 5 is a cross-sectional view of the adhesive tape applicator of the present invention as taken along lines A-A in FIG. 1, showing the roll therein in a second dispensing position (with a projected strip of tape as dispensed from the roll).

In a second dispensing position shown in FIG. 5, roll 16 is positioned on tape hub 18 of tape applicator 10 so that second side surface 82 of roll 16 abuts interior side surface 64 of second housing portion 42. Depending on the width of roll 16, roll 16 is maintained in position on tape hub 18 by ribs 84 and, if as wide as the housing interior, also by interior side surfaces 52 and 64 of first and second housing portions 40 and 42.

Because second side surface 82 of roll 16 is positioned against interior side surface 64 of second housing portion 42, strip 24 of tape 26 being dispensed from housing 14 is aligned such that second side edge 30 of strip 24 of tape 26 from roll 16 is co-linear with exterior side surface 66 of second housing portion 42 and second dispensing edge 90, regardless of the width of roll 16. As a result, when exterior side surface 66 of second housing portion 42 is placed flush against second surface 36, second side edge 30 of strip 24 of tape 26 is dispensed directly along edge 32 of first surface 12 as tape applicator 10 is manually moved in a second direction opposite the first direction.

When roll 16 is in the second dispensing position (FIG. 5), second side edge 30 of strip 24 of tape 26 is co-linear with exterior side edge 94 of third application roller 20*c* (shown in FIGS. 2 and 3). As strip 24 of tape 26 is applied to first surface 12, exterior side edge 94 of third application roller 20*c* applies more pressure on second side edge 30 of strip 24 of tape 26 to ensure more secure adhesion of strip 24 of tape 26 to first surface 12.

Figure 6:
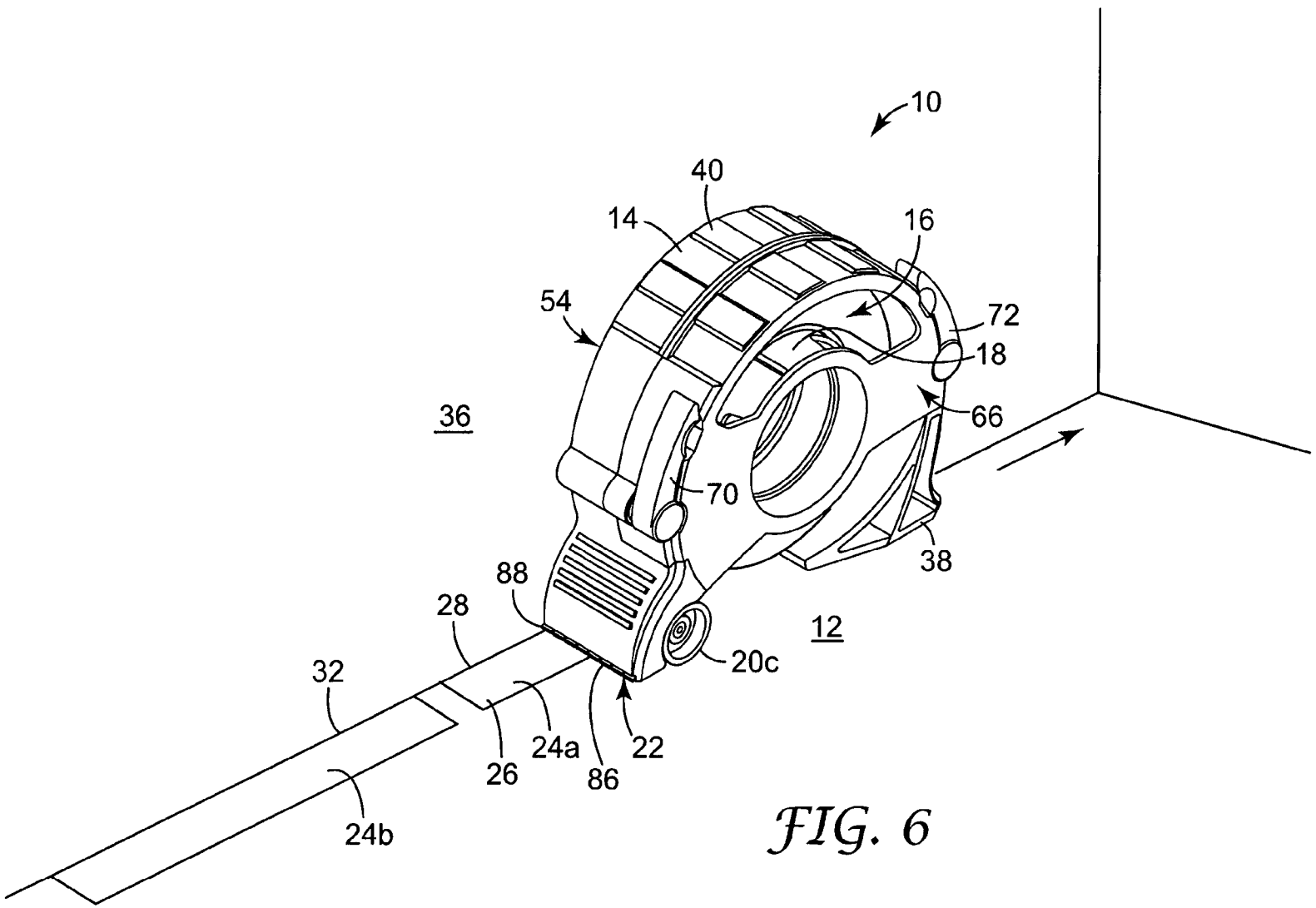
FIG. 6 is a perspective view of the adhesive tape applicator of the present invention in use when the roll is in the first dispensing position.

FIG. 6 is a perspective view of tape applicator 10 applying a first strip 24*a* of tape 26 to first surface 12. To use tape applicator 10 to apply first strip 24*a* of tape 26 to edge 32 of first surface 12, roll 16 is first positioned on tape hub 18 in the first dispensing position (as shown and described relative to FIG. 4). Cutting edge 22 and rear foot 38 are placed on first surface 12 so that first dispensing edge 88 of tape applicator 10 is aligned with edge 32 of first surface 12 and exterior side surface 54 of first housing portion 40 engages second surface 36.

Tape 26 is pulled beneath application rollers 20 and cutting edge 22 onto first surface 12. After securing strip 24 of tape 26 to first surface 12, tape applicator 10 is manually guided along first surface 12 in the first direction, releasing a length of tape 26 from roll 16 as tape applicator 10 moves along first surface 12. Because roll 16 is positioned against interior side surface 52 (shown in FIG. 2) of first housing portion 40, first edge 28 of strip 24 of tape 26 is dispensed from roll 16 co-linearly with first dispensing edge 88 of tape applicator 10 and edge 32 of first surface 12. After strip 24 of tape 26 has been applied along the desired length of edge 32 of first surface 12, strip 24 of tape 26 is separated from roll 16 by blade 86 of cutting edge 22 to define a cut strip of tape 26 (such as tape strip 24*b* in FIG. 6).

Figure 7:
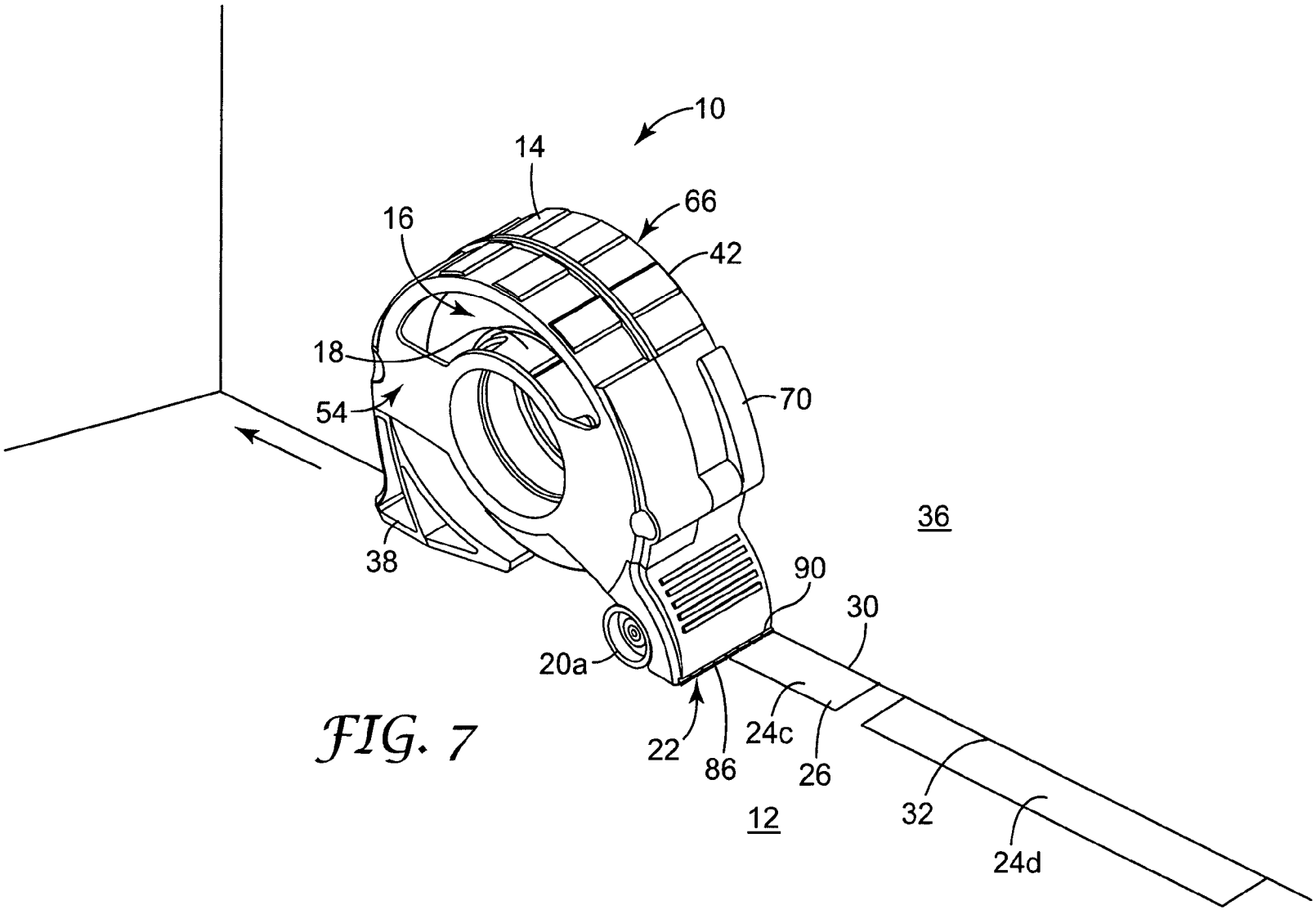
FIG. 7 is a perspective view of the adhesive tape applicator of the present invention in use when the roll is in the second dispensing position.

FIG. 7 is a perspective view of tape applicator 10 applying a second strip 24*c* of tape 26 to first surface 12. To apply second strip 24*c* of tape 26 to first surface 12, roll 16 is slid across tape hub 18 towards second housing portion 42 and positioned in the second dispensing position (as shown and described relative to FIG. 5). Cutting edge 22 and rear foot 38 of tape applicator 10 are placed on first surface 12 so that second dispensing edge 90 of tape applicator 10 is aligned with edge 32 of first surface 12 and exterior side surface 66 of second housing portion 42 engages second surface 36.

Due to the versatile design of tape applicator 10, a strip of tape 26 can be applied to first surface 12 regardless of whether roll 16 is in the first dispensing position or in the second dispensing position. Even though exterior side surface 66 of second housing portion 42 is now engaging second surface 36, tape 26 can still be applied along edge 32 of first surface 12 by guiding tape applicator 10 in the second direction. Tape 26 is pulled beneath application rollers 20 and cutting edge 22 onto first surface 12. After securing strip 24*c* of tape 26 to first surface 12, tape applicator 10 is manually guided along first surface 12 in the second direction, releasing a length of tape 26 from roll 16 as tape applicator 10 moves along first surface 12. Because roll 16 is positioned against interior side surface 64 (shown in FIG. 2) of second housing portion 42, second side edge 30 of strip 24 of tape 26 is dispensed from roll 16 co-linearly with second dispensing edge 90 of tape applicator 10 and edge 32. After strip 24 of tape 26 has been applied along the desired length of edge 32 of first surface 12, strip 24 of tape 26 is separated from roll 16 by blade 86 of cutting edge 22 to define a cut strip of tape 26 (such as tape strip 24*d* in FIG. 7).

If it is desired to move roll 16 from the second dispensing position back to the first dispensing position, roll 16 is slid across tape hub 18 away from second housing portion 42 until first sided edge 80 of roll 16 abuts interior side surface 52 of first housing portion 40 (as again shown in FIG. 4).

Although the present invention has been described with reference to preferred embodiments, workers skilled in the art will recognize that changes may be made in form and detail without departing from the spirit and scope of the invention.

The invention claimed is:

1. A tape application apparatus adapted for both left-handed and right-handed use when applying tape from a roll to a first surface, wherein an edge of the first surface is common to an edge of an adjacent second surface, the tape application apparatus comprising:

a housing having first and second exterior side surfaces and first and second interior side surfaces, and the housing being adapted to receive the roll; and a tape hub attached between the first and second exterior side surfaces of the housing and capable of slidably receiving the roll, wherein when the tape application apparatus is guided in a first direction, the roll is moveable to a first dispensing position against the first interior side surface such that an edge of tape dispensed from the tape application apparatus is co-linear with the edge of the first surface, and wherein when the tape application apparatus is guided in a second direction opposite the first direction, the roll is moveable to a second dispensing position against the second interior side surface such that an edge of tape dispensed from the tape application apparatus is co-linear with the edge of the first surface.

2. The tape application apparatus of claim 1, and further comprising:

a plurality of application rollers attached to the housing for firmly pressing tape to the first surface.

3. The tape application apparatus of claim 2, wherein at least one of the application rollers has a varying diameter.

4. The tape application apparatus of claim 1, and further comprising:

means for fictionally maintaining the roll to the tape hub in both the first dispensing position and the second dispensing position.

5. The tape application apparatus of claim 4, wherein the means for frictionally maintaining the roll to the tape hub comprises a plurality of protrusions projecting outwardly from the tape hub.

6. The tape application apparatus of claim 1, wherein the first exterior side surface and the second exterior side surface are tapered toward a tape dispensing edge on each side of the housing.

7. The tape application apparatus of claim 1, wherein the tape hub is capable of slidably receiving rolls of tape of varying tape widths.

8. The tape application apparatus of claim 1, wherein the tape hub is rotatably connected to the housing.

9. A tape dispenser for applying a strip of tape from a roll onto a first surface wherein an edge of the first surface is common to an edge of a second adjacent surface, wherein the roll has a first width, and wherein the strip of tape has first and second side edges, the tape dispenser comprising:

a frame adapted to receive the roll, the frame having a first tape dispensing edge on a first side thereof and a second tape dispensing edge on a second side thereof; and a tape hub attached between the first and second sides of the frame, the tape hub having a second width that is greater than the first width of the roll and being formed to slidably receive the roll thereon, wherein the roll is slidable between a first dispensing position on a first side of the tape hub, wherein when in the first dispensing position, the first side edge of the strip of tape being dispensed from the roll is co-linear with the first dispensing edge of the first side of the frame and co-linear with the edge of the first surface, and a second dispensing position on a second side of the tape hub, wherein when in the second dispensing position, the second side edge of the strip of tape being dispensed from the roll is co-linear with the second dispensing edge of the second side of the frame and co-linear with the edge of the first surface.

10. The tape dispenser of claim 9, and further comprising:

means for frictionally maintaining the roll to the tape hub in both the first dispensing position and the second dispensing position.

11. The tape dispenser of claim 10, wherein the means for frictionally maintaining the roll to the tape hub comprises a plurality of protrusions projecting outwardly from the tape hub.

12. The tape dispenser of claim 9, and further comprising:

a plurality of application rollers mounted relative to the frame for pressing the strip of tape firmly against the first surface.

13. The tape dispenser of claim 12, wherein at least one of the application rollers has a varying diameter.

* * * * *